US006055885A

United States Patent [19]

Shea

[11] Patent Number: 6,055,885

[45] Date of Patent: May 2, 2000

[54] DOOR OPERATOR WITH DETACHABLE ELECTRIC MOTOR

[76] Inventor: Chung-Shien Shea, 3 Fl., No. 225, Chung-Cheng Rd., Lin-Kou Hsiang, Taipei Hsien, Taiwan

[21] Appl. No.: 08/931,325

[22] Filed: Sep. 16, 1997

[51] Int. Cl.[7] ..... E06B 9/74

[52] U.S. Cl. ..... 74/625; 160/310; 49/140

[58] Field of Search ..... 74/625; 49/140, 49/139; 160/310, 311, 188

[56] References Cited

U.S. PATENT DOCUMENTS

| | | | |
|---|---|---|---|
| 1,441,229 | 1/1923 | Lacey | 160/310 |
| 2,096,251 | 10/1937 | Knight et al. | 74/625 |
| 2,670,065 | 2/1954 | Stevens, Jr. | 74/625 |
| 3,853,167 | 12/1974 | Wardlaw | 160/188 |
| 4,721,146 | 1/1988 | Wardlaw | 160/310 |
| 5,700,196 | 12/1997 | Banemann et al. | 192/56.1 |

FOREIGN PATENT DOCUMENTS

| | | | |
|---|---|---|---|
| 530754 | 8/1954 | Belgium | 160/310 |

*Primary Examiner*—David A. Bucci
*Assistant Examiner*—William C Joyce
*Attorney, Agent, or Firm*—Bucknam and Archer

[57] ABSTRACT

A door operator comprising electric actuating motor; a reduction gear; manual transmission mechanism between the electric actuating motor and the reduction gear, the electric actuating motor and the manual transmission mechanism independently actuating the reduction gear; a proximal clutch with a proximal disc, which is mounted on a rotating shift of the manual transmission shaft; an end disc of the proximal clutch secured on the rotating shaft of manual transmission mechanism; and an electromagnet secured on a bearing seat inside a housing of the manual transmission mechanism, which is controllable to produce a magnetic effect for a pull chain disc sleeved on the bearing seat to move axially.

1 Claim, 10 Drawing Sheets

DOOR OPERATOR WITH DETACHABLE ELECTRIC MOTOR

FIELD OF THE INVENTION

This invention relates to a door operator mechanism, particularly to a door operator with detachable electric actuating means which may be manually operated to roll up the shutter to open the door after detachable electric actuating means is disassembled.

BACKGROUND OF THE INVENTION

Generally the electric door operator is provided with a pull chain in addition to the electric actuating means for manually operating to roll up the shutter upon the failure of the electromotor or the interruption of service. FIG. 1 shows a door operator 1 conventionally used in orient countries, which is constituted of a pull chain disc 11, an electromotor 12 and a reduction gear box 13 in a sequence from the right to the left. The actuating force of the electromotor 12 is transmitted through the reduction gear box 13 to an output end 131 to roll the reel to close or open the shutter. Upon the failure of the electromotor or the interruption of service, a pull chain 111 is manually pulled to turn the rotating shaft of the electromotor 12 to roll the curtain slats. Since the pull chain disk 11 is provided on the outer end of the electromotor 12, when the electromotor 12 is disassembled for the purpose of maintenance, the pull chain 11 will be disassembled simultaneously, as a result of which the shutter cannot be closed or opened. Or, as found in the available door operator such as a door operator 1*a* is manufactured by Raynor Garage Doors of Illinois, USA as shown in FIG. 2 and a door operator 1*b* manufactured by Wayne-Dalton Corporation of Ohio, USA as shown in FIG. 3 the manual pull chain requires a manual pull rod for switching to a manual operation and hence it is inconvenient. Respectively as shown in FIGS. 2 and 3, the actuating force of electromoter 12*a*, 12*b* is transmitted through reduction gear boxes 13*a*, 13*b* which change axial direction at 90 degree to output ends 131*a*, 131*b* to roll the reel to close or open the shutter. Though upon the failure of the electromotors 12*a*, 12*b* or the interruption of service, pull chains 111*a*, 111*b* may be manually pulled to roll the reel to wind the shutter, it is inconvenient in usage due to the need of another hand to draw the pull chain 14*a*, 14*b* to switch to a manual operation.

SUMMARY OF THE INVENTION

In view of the above, one object of this invention is to provided a door operator with detachable electric actuating means wherein manual transmission means is provided between an electromotor and a reduction gear, and electric actuating means and manual transmission means are normally separate from each other and may be used independently.

According to this invention, the actuating force output by electric actuating means is transmitted by a proximal disc under the action of a tension spring to a proximal clutch end disc of manual transmission means. The manual transmission means includes a rotating shaft rotated through a proximal disc and a proximal clutch end disc both of which are actuated by the electric transmission means. On the rotating shaft there are provided sequentially from the right to the left; the proximal clutch end disc secured on the rotating shaft; electromagnetic means on the left side of the proximal clutch end disc, the electromagnetic means secured on a bearing seat about the rotating shaft in a housing of the manual transmission means; a tension spring sleeved on the bearing seat with one end pressing against the right end face of a pull chain disc of the manual transmission means whereby the left end face of the pull chain disc may frictionally contact with the distal clutch shoe secured on the rotating shaft; and a pull chain wound about the outer circumferential rim of the pull chain disc for pulling by hand.

In using the present invention, when an electric current is applied to the electric actuating means for the electromotor to rotate, the electromagnet of the manual transmission means will be excited to absorb the pull chain disc onto the iron core. Upon the stoppage or failure of the electromotor or the interruption of service, the pull chain disc under the action of the tension spring will frictionally contact with the distal clutch shoe. Therefore, even after the whole electric actuating means is disassembled, it is still possible to draw manually the pull chain disc and the force applied to the frictionally coupled distal clutch shoe will rotate the rotating shaft to roll up the shutter.

Since the electric actuating means and the manual transmission means according to this invention may work independently, in case of emergency, for example, in case of the interruption of service, the shutter may be opened by simply pulling the manual transmission means without the need to operate by both hands at first and therefore it is convenient.

A BRIEF DESCRIPTION OF DRAWINGS

The above and further objects and novel features of this invention will more fully appear from the following detailed description with reference to the accompanied drawings, in which.

DETAILED DESCRIPTION OF THE PREFERRED EMBODIMENTS OF THIS INVENTION

Figure 1:
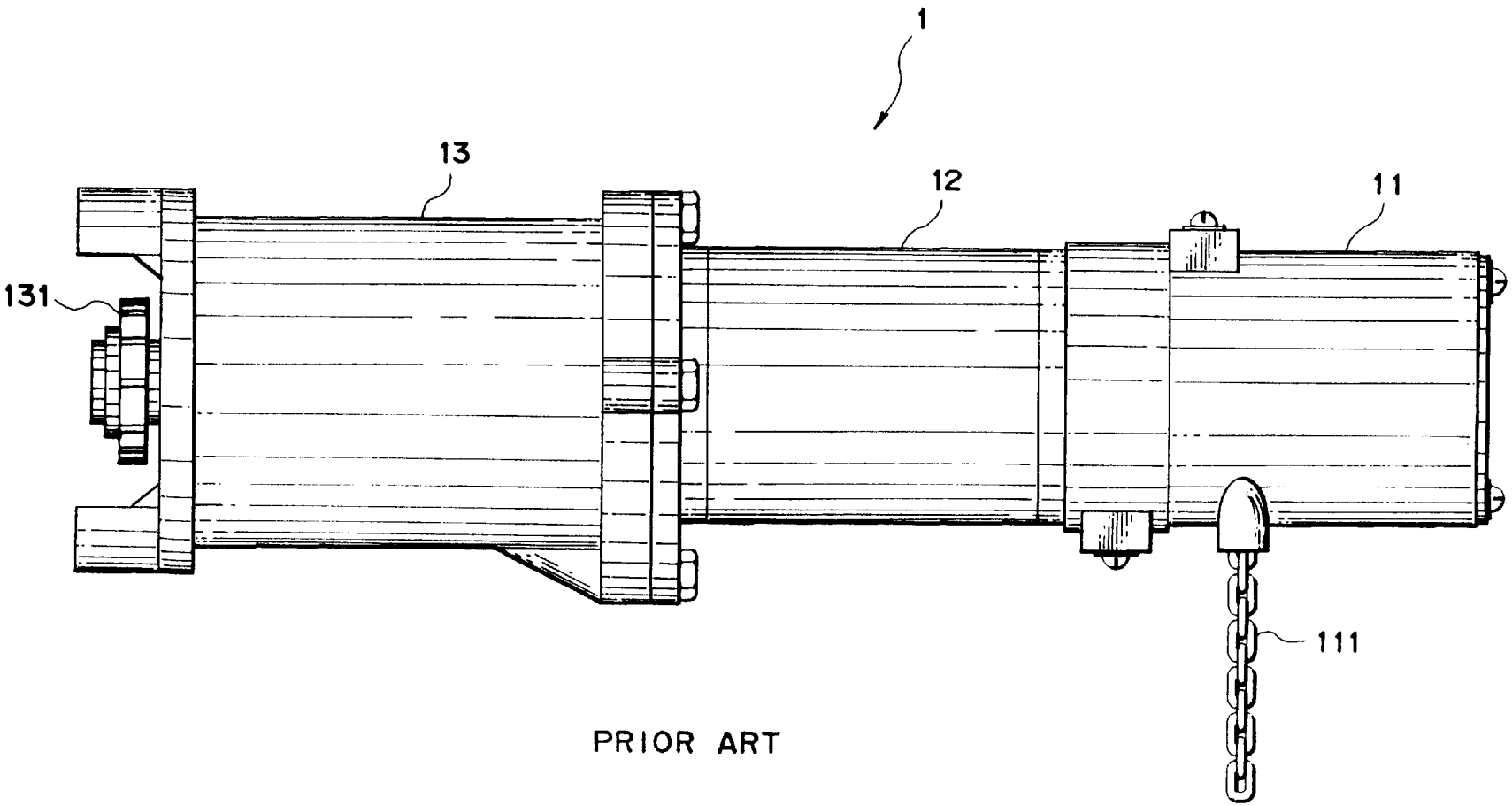
PRIOR ART FIG. 1
FIG. 1 is a front view of a conventional door operator.
Figure 2:
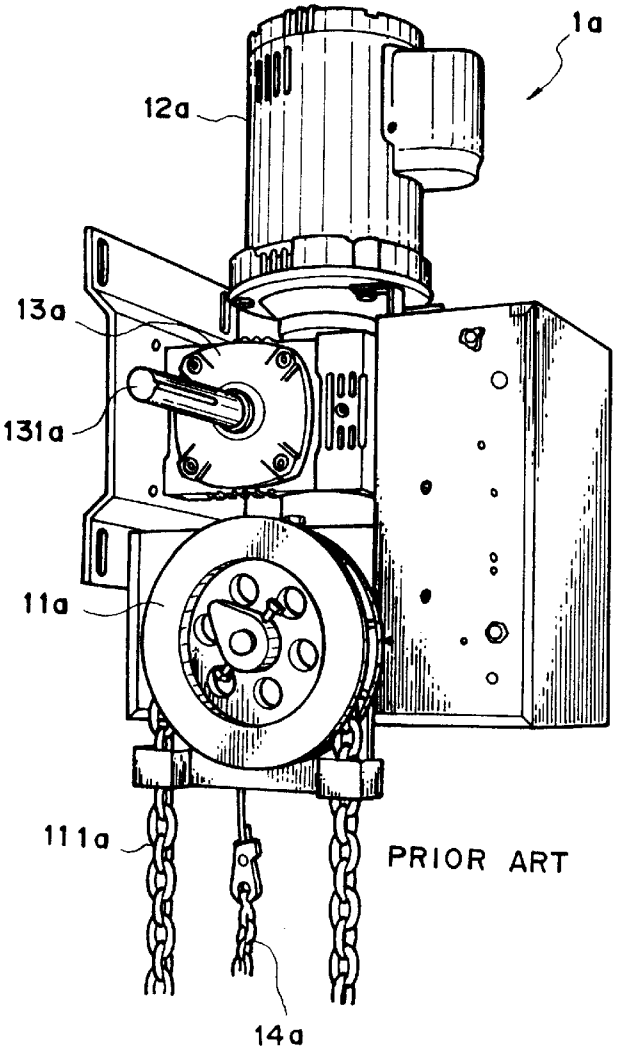
FIG. 2 is a perspective view of a door operator manufactured by Rayer Garage Doors of Illinois, USA.
Figure 3:
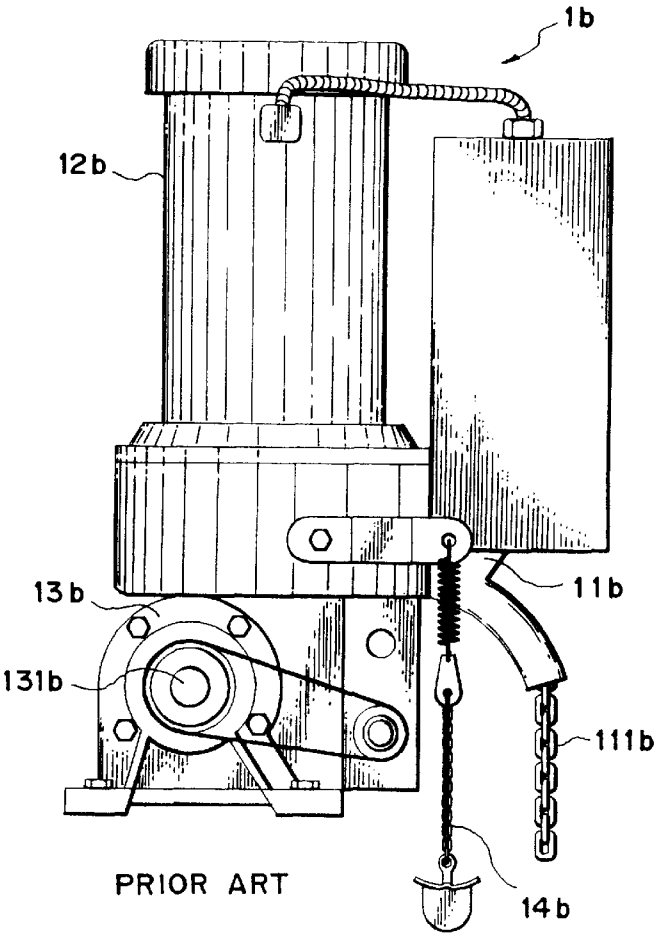
FIG. 3 is a perspective view of a door operator manufactured by Wayne-Dalton Corporation of Ohio, USA.
Figure 4:
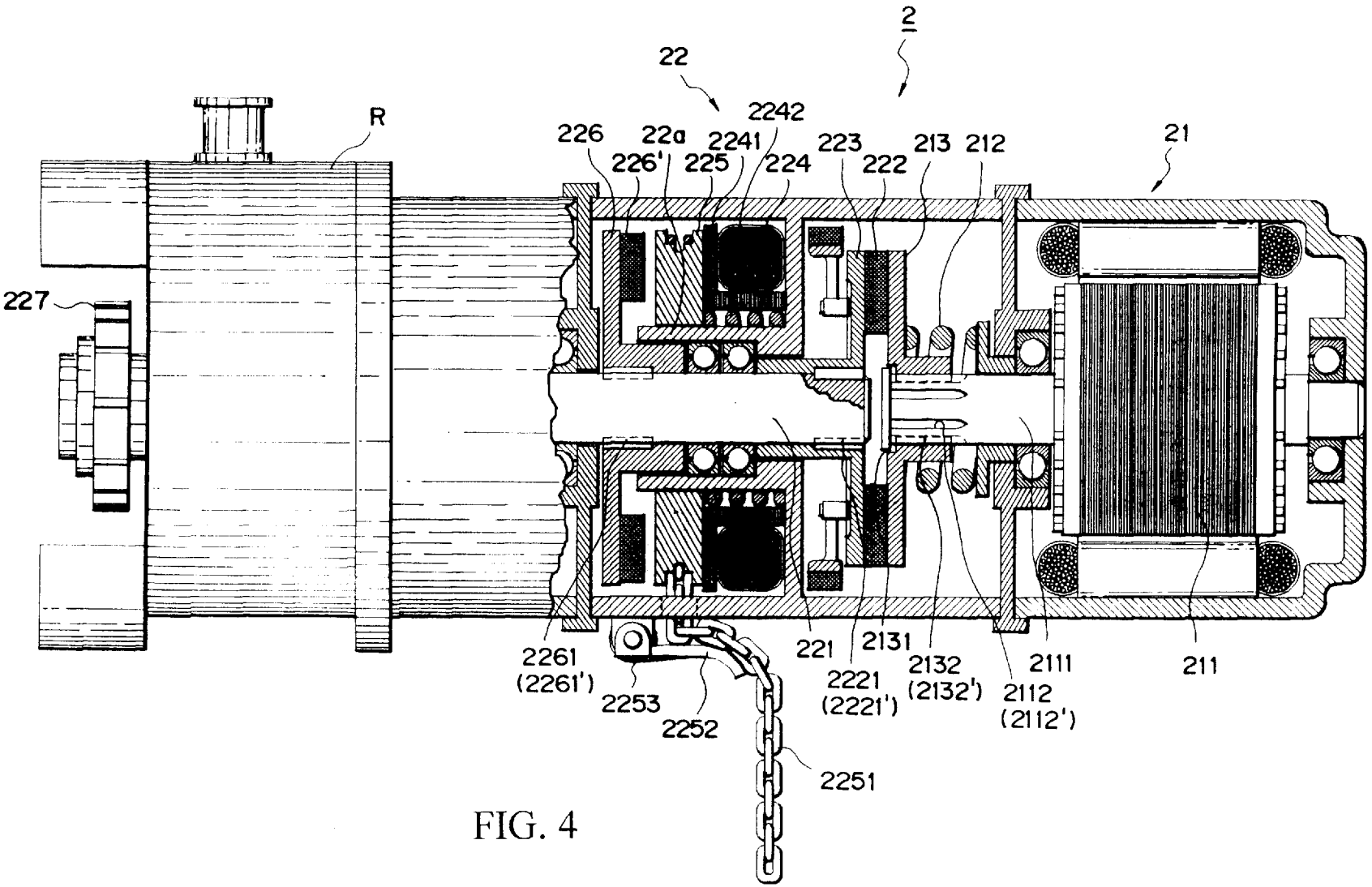
FIG. 4 is a partial sectional view of a door operator according to this invention, schematically showing a state in which an electromotor is actuated; a pull chain disc is absorbed onto one side of an iron core; and a distal clutch shoe is released.

As shown in FIG. 4, a door operator 2 according to this invention comprises electric actuating means 21, manual transmission means 22 and a conventional reduction gear R on the left said of the manual transmission means 22. The actuating force of the electric actuating means 21 is transmitted to a reduction gear R through a proximal clutch constituted of a proximal disc 213 and a proximal clutch end disc 223 of the manual transmission means 22, and further to an output end 227 such as key wheel after speed variation, as a result of which the output end 227 will rotate.

Further referring to FIG. 4, the proximal disc 213 on a rotating shaft 2111 of an electromotor 211 of the electric actuating means 21 is provided with a plurality of rectangular splines 2132, 2132' on the bore wall of a central bore 2131 to loosely engage with a plurality of rectangular splines 2112, 2112' on the end of the rotating shaft 2111 of the electromotor 211 and therefore the proximal disc 213 tends to axially slide. A tension spring 212 sleeved about the rotating shaft 2111 of the electromotor 211 biases against the bearing seat of the electromotor 211 at one end while it biases against the right end surface of the proximal disc 213 at the other end whereby the proximal disc 213 may press against a clutch shoe 222 which is constituted of a plurality of linings on the proximal clutch end disc 223 of the manual transmission means 22.

The rotating shaft 221 of the manual transmission means 22 may serve as an input shaft of the reduction gear R, or alternatively may connect with an input shaft separately provided on the reduction gear R through a coupler. The assemblage thereof is proceeded sequentially from the right to the left on the shaft assembly as disclosed hereinafter. The clutch shoe 222 is fixed onto the end face of the proximal clutch end disc 223 at one end of the rotating shaft 221 with a plurality of securing pins 2221, 2221'.

Electromagnetic means 224 is fixed on a bearing seat 22*a* in a housing of the manual transmission means. A pull chain 2251 is wound around the outer circumferential rim of a pull chain disc 225 accommodated in the bearing seat 22*a* with both ends extending vertically downward through the housing to the position for pulling chain. A tension spring 2242 which is provided on the bearing seat 22*a* biases against the right end face of the chain disc 225 with the front end and the end face of the bearing seat 22*a* with the rear end respectively all the time whereby the pull chain disc 225 is biased leftward continuously. On the end face of a distal clutch end disc 226 there is fixed a clutch shoe 226' which is secured on the intermediate end portion of the rotating shaft 221 with a plurality of securing pins 2261, 2261' whereby the pull chain disc 225 may move forward under control in such a manner that the left end face of the pull chain disc 225 is frictionally coupled with the distal clutch shoe 226'. Thus, a distal clutch assembly is formed. Adjacent to the place where both ends of the pull chain 2251 extend out of the housing, a pressing plate 2252 under the action of an annular spring 2253 is pressed onto the outer wall of the housing to bend at 90 degree angle so that the pull chain disc 225 in the non-operative state as shown in FIG. 4 will not swing undesirably.

According to this invention, when an electric current is applied for the electromotor 211 to rotate, by using a conventional circuit the electromagnetic means 224 will be excited upon being electically conducted. Under the magnetic action the pull chain disc 225 will overcome the tension of the tension spring 2242 to move rightward, as a result of which the pull chain disc 225 will depart from the shoe 226' on the distal clutch end disc 226. Thus, the actuating force of the electromotor 211 will be transmitted through the proximal disc 213 and the clutch end disc 223 to the rotating shaft 221 which will then rotate, and to the reduction gear R which will variate the speed, and finally to the output end 227, i.e. the key wheel, to be output. On the other hand, when the electromotor 211 stops rotating in case of the failure or the interruption of service the pull chain disc 225 under the action of the tension spring 2242 will recoil to press against the shoe 226'.

Figure 7:
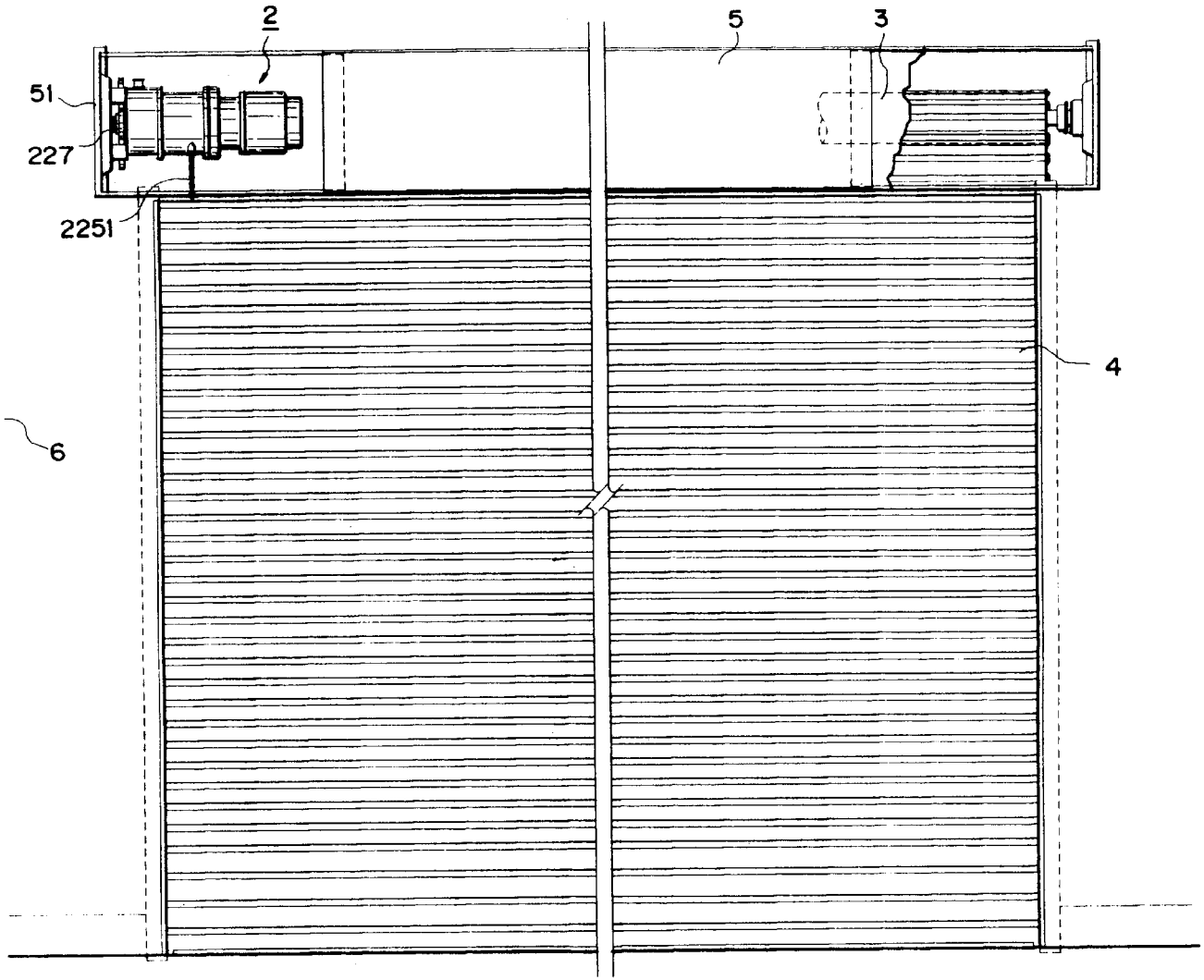
FIG. 7 is a view showing the structure of an electromotive shutter fitted with the door operator according to this invention.
Figure 8:
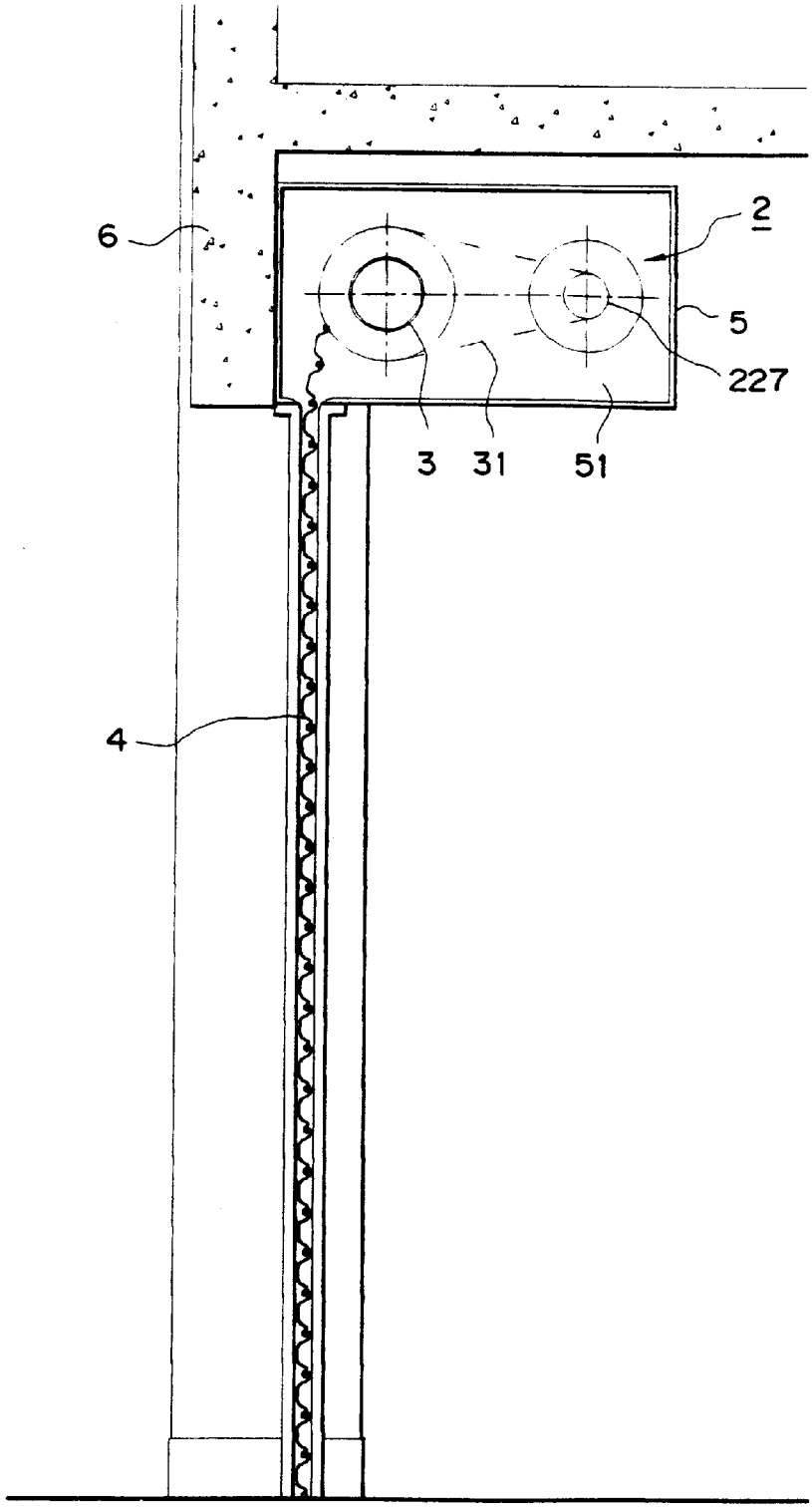
FIG. 8 is a side view of the structure as shown in FIG. 7.

Referring to FIGS. 7 and 8, in a conventional way the door operator 2 of this invention is mounted on a wall 6 of a building above the door frame. A casing 5 is provided to accommodate a shutter 4 covered around a reel 3. The actuating force at the output end 227 of the door operator 2 on a side plate 51 of the casing 5 is transmitted to the reel 3 through the pull chain 31 to open the door by rolling up the shutter 4 or close the door by rolling down the shutter 4. The pull chain 2251 on the door operator 2 serves as spare means to be manually operated upon the failure of the electromotor or the interruption of service.

Figure 5:
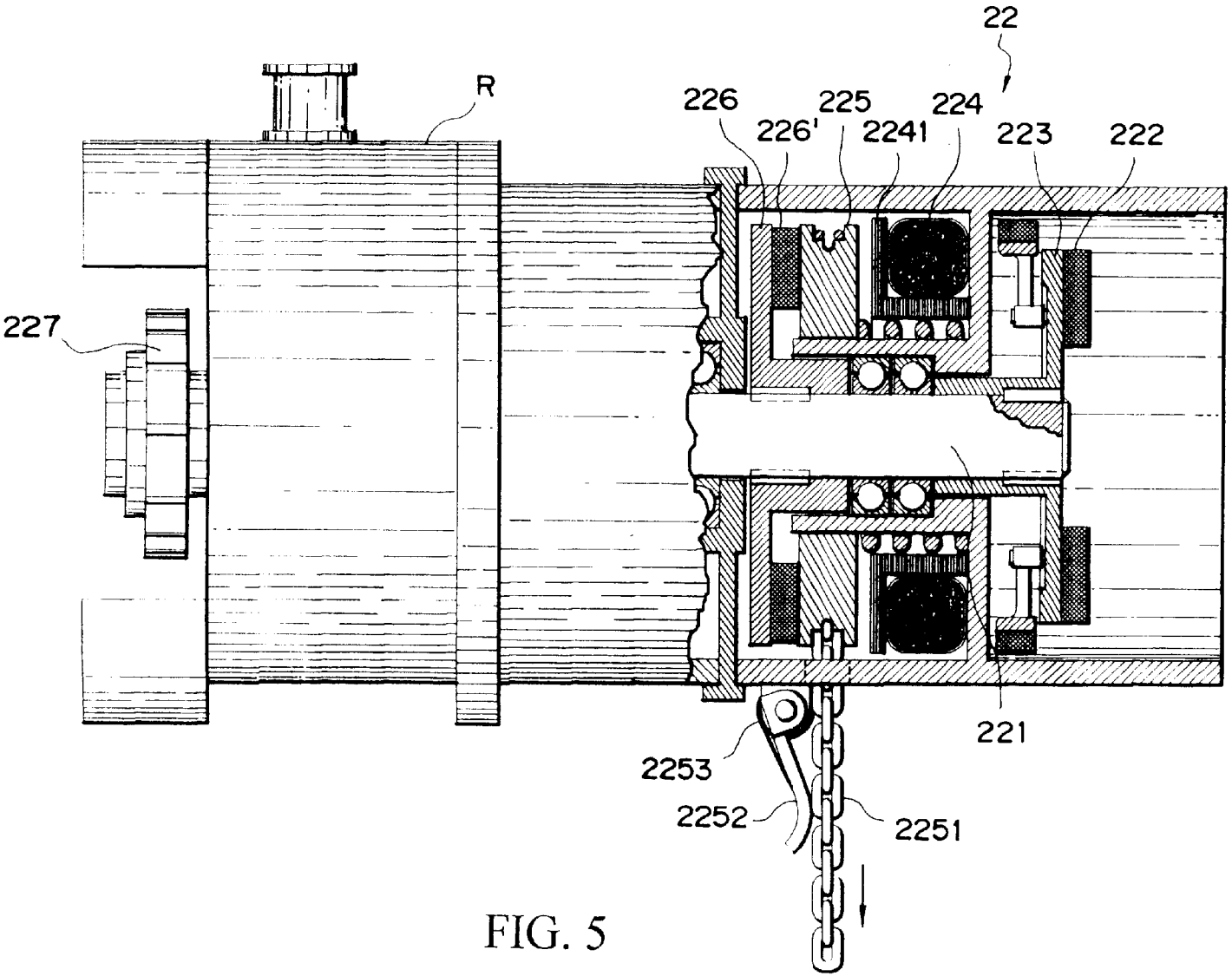
FIG. 5 is a partial sectional view of the door operator shown in FIG. 4 with an electromotor disassembled, showing a state in which the pull chain disc and the distal clutch shoe frictionally contact each other.

The manual transmission means 22 and the reduction gear R are shown in FIG. 5, illustrating a position in which the electromotor 21 is detached due to failure. As shown, the pull chain disc 225 under the action of the tension spring 2242 is pressed against the shoe 226' to attain a coupled position. When the pull chain 2251 is manually pulled, the pull chain 2251 will act against the annular spring 2253 to press down a pressing plate 2252. Upon pulling the pull chain 2251, the rotating shaft 221 rolls the shutter 4 at the output end 227 of the reduction gear R through the end disc 226 secured onto the distal clutch shoe 226'.

As shown in FIG. 4, the driving force from the rotating shaft 2111 of the electromotor 2 is transmitted in sequence through the proximal disc, the proximal clutch shoe 222 to the rotating shaft 221. Alternatively, the rotating shaft 2111 of the electromotor 2 may be integral with the rotating shaft 221. The object of the detachable actuating means according to this invention is attainable by the omission of the tension spring 212, the proximal disc and the proximal clutch end disc 223 in design.

Figure 6:
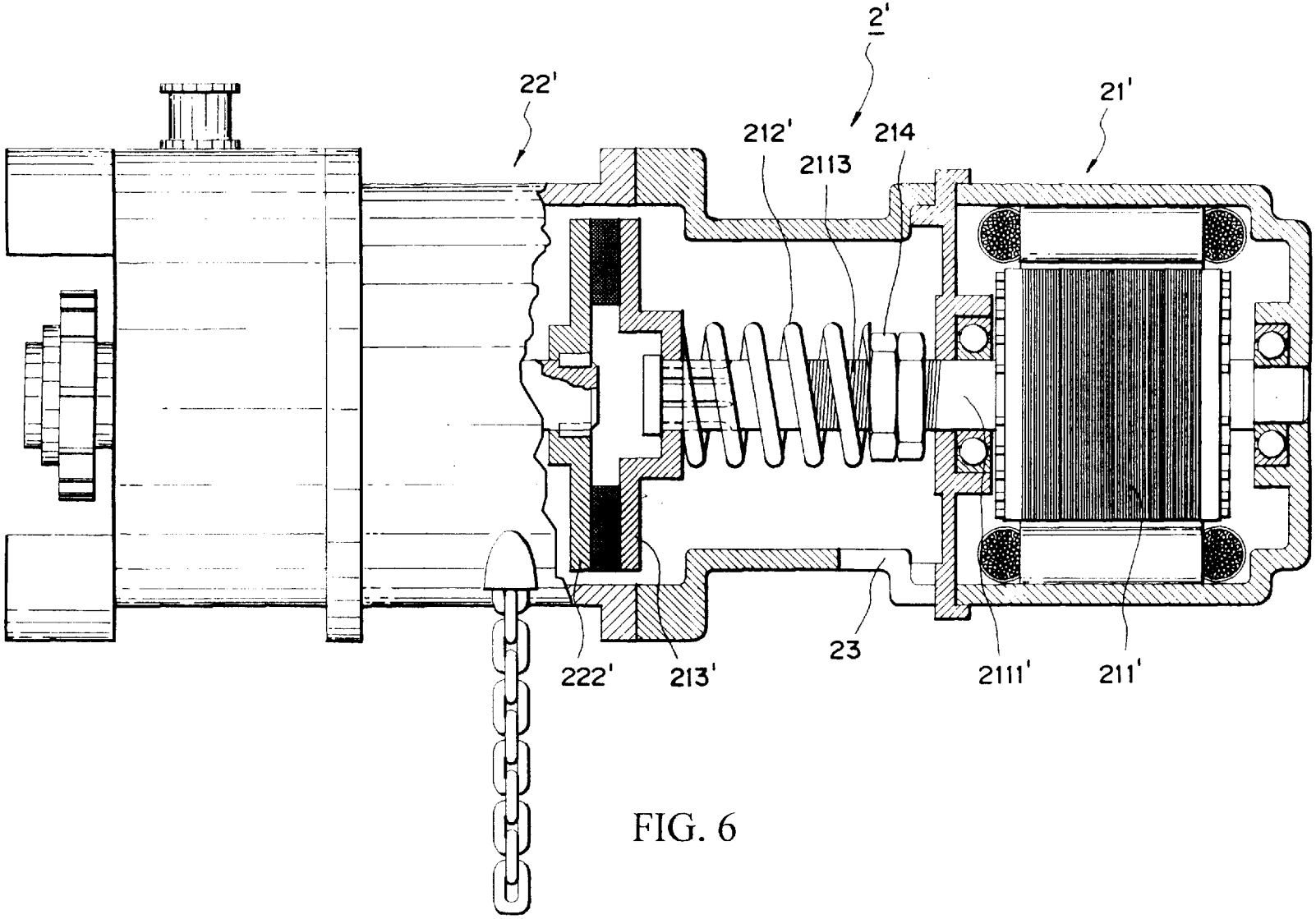
FIG. 6 is a sectional view of an alternative embodiment according to this invention, showing the tension state of an adjustable tension spring.

In FIG. 6 which shows the structure of a second embodiment of this invention, the manual transmission means is the same as shown in FIG. 7 and therefore the description thereof is omitted. As shown in FIG. 6, a proximal disc 213' is slidably mounted on the output end of the rotating shaft 2111' of the electromotor 211' in the electric actuating means 21'. A plurality of protrusions are provided on the inner peripheral surface of the central bore of the proximal disc 213' to slidably engage with a plurality of elongate grooves. On the proximal end of the rotating shaft 2111' of the electromotor 211 there is provided with a thread for a nut 214 to fasten thereon. A tension spring 212' is sleeved on the rotating shaft 2111' between the nut 214 and the proximal disc 213'. The housing is provided with an opening 23 on a position corresponding to the nut 214 whereby a spanner may be used to turn the nut 214 from outside of the housing through the opening 23 to adjust the force applied by the tension spring 212' against the proximal disc 213', i.e. the optimum force required for the shutter to be rolled, as a result of which the shutter may be rolled within a predetermined range of load by the door operator of this invention. And therefore, with the provision of the door operator of the detachable electric actuating means according to this invention, the shutter may still be rolled by pulling the chain after detachable electric actuating means is disassembled for maintenance.

Figure 9:
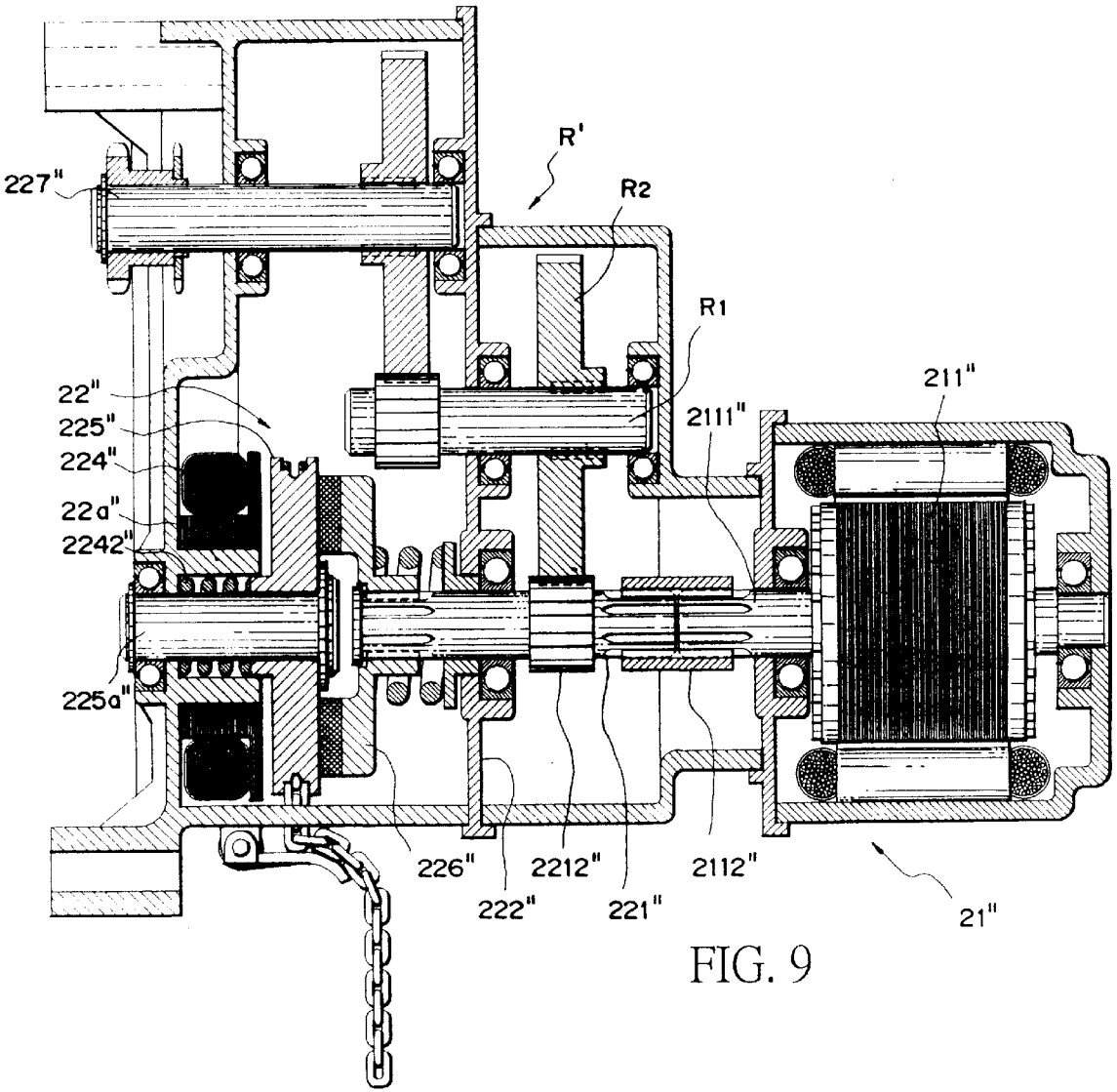
FIG. 9 is a sectional view of a third embodiment according to this invention, showing a position wherein the reduction gear is on one side of the electric actuating means and the manual transmission means while the whole door operator is at rest.

FIG. 9 show a structure of a third embodiment according to this invention. As shown, a rotating shaft 2111" of an electromotor 211" of an electric actuating means 21" is connected at an output end thereof with a proximal of an intermediate rotating shaft 221" through a coupler 2112" whereby the intermediate rotating shaft 221" under a force transmitted by the electromotor 211" will rotate on a bearing seat 222". On a distal end of the intermediate rotating shaft 221" at a certain distance from the proximal end thereof is secured a clutch end disc 226". On a portion of the inner wall of the housing concentric with the intermediate rotating shaft 221" is formed a hollow receiving column 22*a*″ in which a spring 2242" is disposed. One end of a short shaft 225*a*' extends through the spring 2242" and then is pivotally mounted on the housing while the other end thereof is slidably sleeved on a chain disc 225" whereby the chain disc 225" acted by the spring tends to slide forward and biases against the end face of the clutch end disc 226". An electromagnetic means 224" secured on the outer circumferential rim of the receiving column 22*a*" is electrically conducted to generate a magnetic force which acts upon the chain disc 225", as a result of which the chain disc 225" moves leftward against the spring 2242". A gear 2242" is secured on the middle portion of the intermediate; rotating shaft 221" to engage with a gear R2 of an input shaft R1 of the reduction gear R'.

Figure 10:
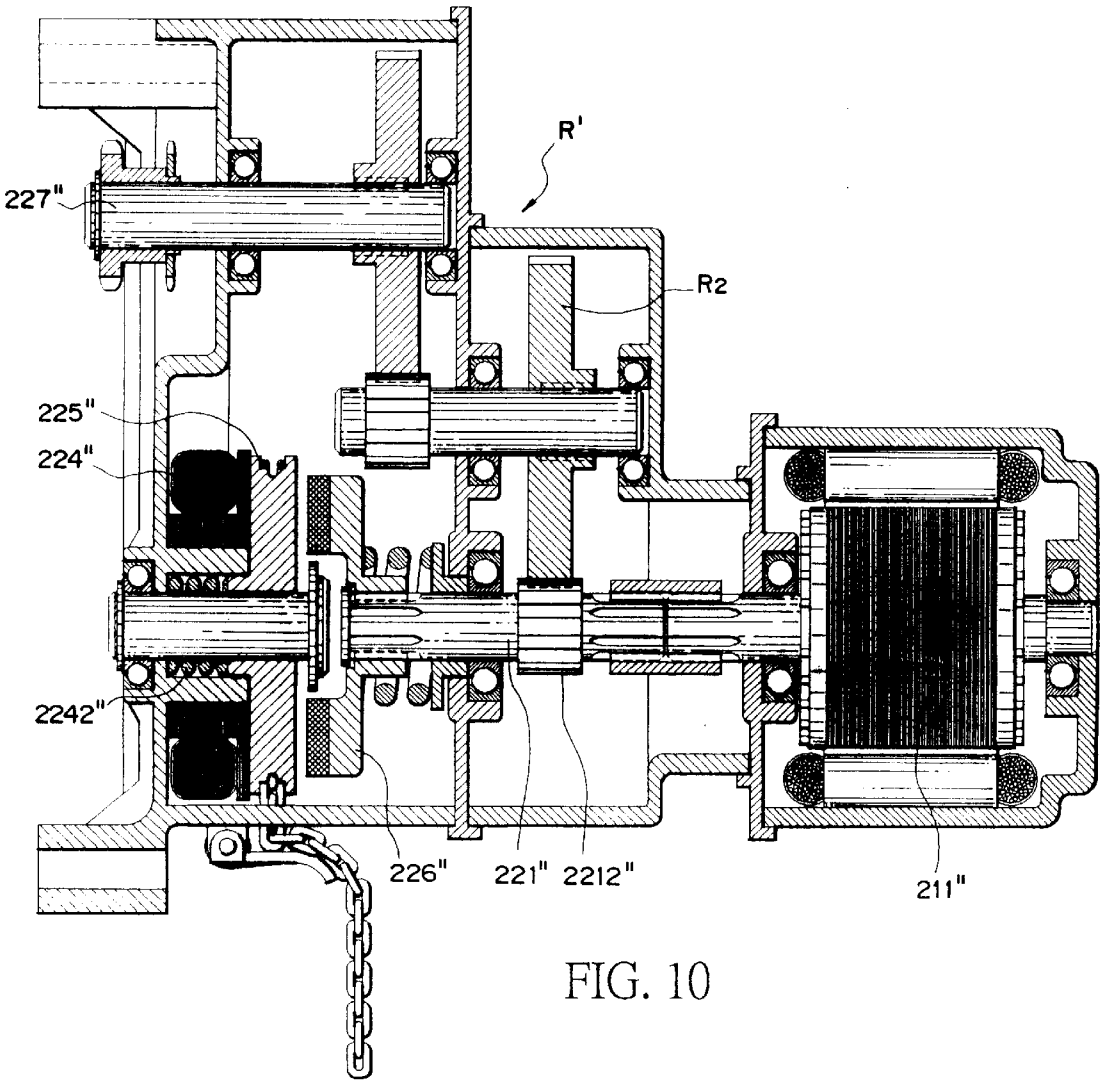
FIG. 10 is a view of the embodiment as shown in FIG. 9 except that the door operator has been turned on to roll the shutter.

With the provision of such a structure, in case of normal use, when the electromotor 211" is turned on by means of the conventional electric current control circuit, a force is transmitted to the intermediate rotating shaft 221" for the gear 2212" fixed thereon to rotate the reduction gear R' through the gear R2 and thereby change the speed. Finally, the force is output through the output end 227". At the same time when the electromotor 211" rotates, the electromagnetic means 224" effected by the conventional control circuit gererates a magnetic force to act upon the chain disc 225", as result of which the chain disc 225" will overcome the force of the spring 2242" and move leftward to a position disengaging with the clutch end disc 226" as shown in FIG. 10. Thus, the force of the electromotor 211" will not be transmitted to the chain disc 225".

Figure 11:
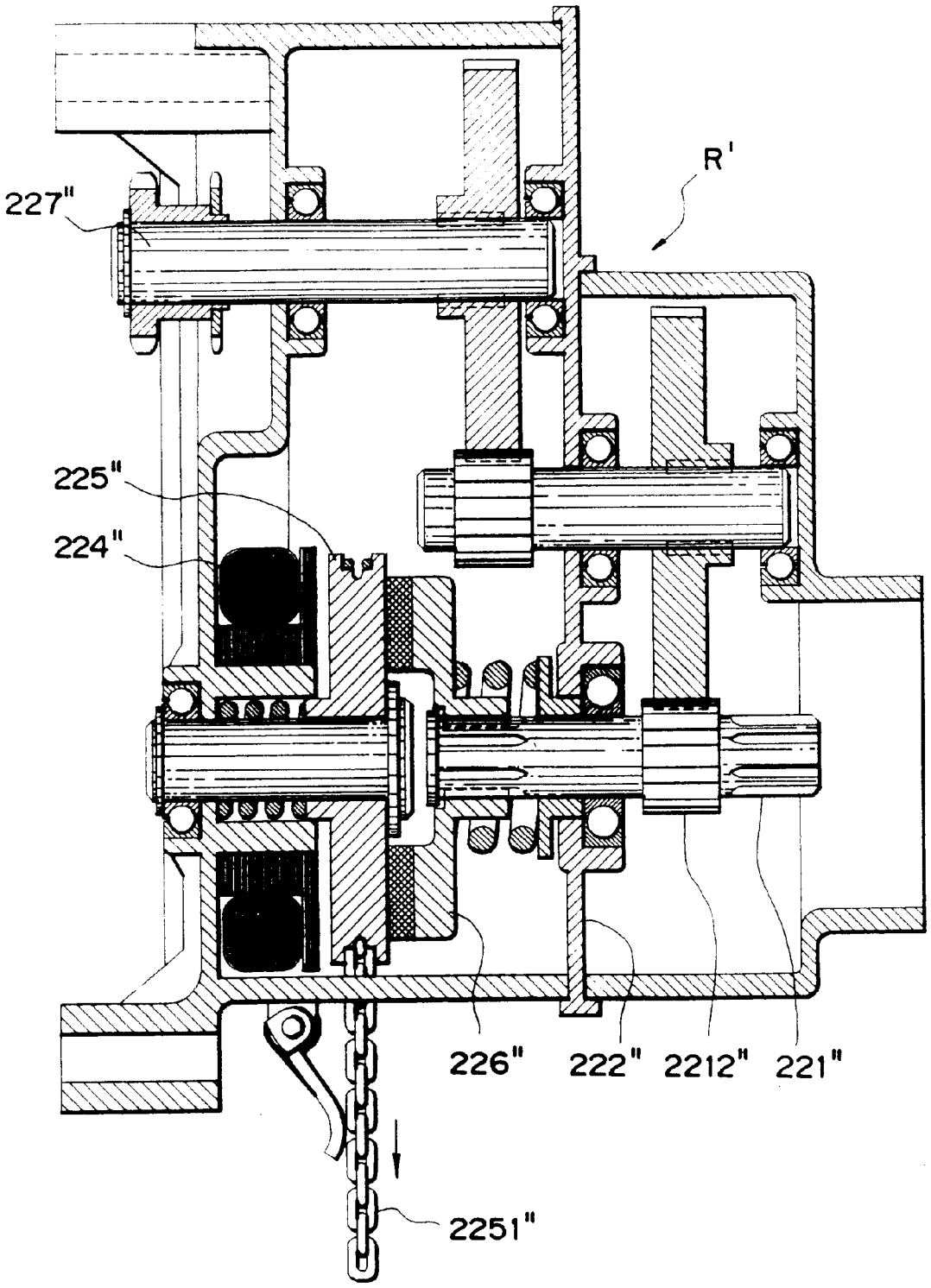
FIG. 11 shows the disassembly of the electromotor of the embodiment of FIG. 9.

On the contrary, in absence of the electric current, the chain disc 225" will be biased forward by the spring 2242" to press against the clutch end disc 226". Therefore, in case that the electromotor 211" is disassembled due to failure as shown in FIG. 11, a manual pull chain 2251" may be employed instead. The chain disc 225" and the clutch end disc 226" frictionally contact with each other to drive the intermediate rotating shaft 221" whereby the output end 227" of the reduction gear R'; rotates the shaft (not shown) of the shutter.

While preferred embodiments of this invention have been described using specific terms, such description is for illustrative purposes, and it is to be understood that changes and variations may be made without departing from the spirit or scope of the following claims.

What I claimed is:

1. A door operator with detachable electric actuating motor, said door operator comprising:

said electric actuating motor for electrically rolling a reel of a shutter;

a reduction gear box;

a manual transmission mechanism disposed between said electric actuating motor and said reduction gear box detachably coupled with said electric actuating motor;

the actuating force of said electric actuating motor being transmitted through said manual transmission mechanism by a rotating shaft of said electric actuating motor to a shaft of said reduction gear box;

said manual transmission mechanism comprising a hollow housing having a first end portion connected to said electric actuating motor and a second end portion connected to said reduction gear box, an axial bearing seat disposed inside said housing for said rotating shaft of said reduction gear box to extend therethrough, an electromagnetic coil for creating a magnetic force disposed around said bearing seat, a pull chain disc having two end sides and on the outer circumferential rim of which there is wound a pull chain extending out of said housing, one of said end sides of said pull chain disc being adjacent to a side of said electromagnetic coil and arranged on said bearing seat to slidably move thereon, a clutch disc secured on said rotating shaft of said reduction gear box disposed adjacent to the other one of said end sides of said pull chain disc, and a biasing spring acting against one of said end sides of said pull chain disc to bias said pull chain disc to contact said clutch disc; and a pressing plate having a first end pivotally attached to said manual transmission mechanism housing proximate an outlet for said pull chain through said housing and a second end spring biased to press the extending portion of said pull chain against said housing so that when said pull chain is pulled to overcome the spring bias acting on the second end of said pressing plate the pull chain can be moved to rotate said pull chain disc.

* * * * *